US009217606B2

(12) United States Patent
Schons et al.

(10) Patent No.: US 9,217,606 B2
(45) Date of Patent: Dec. 22, 2015

(54) DOOR AND VALVE ASSEMBLY FOR A CHARGING INSTALLATION OF A SHAFT FURNACE

(75) Inventors: Stefan Schons, Tawern (DE); Frederic Parasch, Dudelange (LU); Paul Tockert, Berbourg (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 14/122,804

(22) PCT Filed: Jun. 5, 2012

(86) PCT No.: PCT/EP2012/060581

§ 371 (c)(1),
(2), (4) Date: Nov. 27, 2013

(87) PCT Pub. No.: WO2012/168227

PCT Pub. Date: Dec. 13, 2012

(65) Prior Publication Data

US 2014/0112738 A1 Apr. 24, 2014

(30) Foreign Application Priority Data

Jun. 8, 2011 (LU) ..... 91822

(51) Int. Cl.
*B66C 17/08* (2006.01)
*F27D 3/10* (2006.01)
(Continued)

(52) U.S. Cl.
CPC ... *F27D 3/10* (2013.01); *C21B 7/20* (2013.01); *F27B 1/20* (2013.01); *F27D 3/0033* (2013.01); *F27D 2003/105* (2013.01)

(58) Field of Classification Search
CPC ..... C21B 7/20; F27B 1/20; F27D 2003/105; F27D 3/0033; F27D 3/10
USPC ..... 414/199–206
See application file for complete search history.

(56) References Cited

U.S. PATENT DOCUMENTS 3,675,961 A * 7/1972 Wheeler ..... 294/67.1
3,732,994 A * 5/1973 Yoshioka et al. ..... 414/205
(Continued)

FOREIGN PATENT DOCUMENTS

WO 2010015566 A1 2/2010
WO 2010081810 A1 7/2010

OTHER PUBLICATIONS

International Preliminary Report on Patentability issued Dec. 12, 2013; re: PCT/EP2012/060581.
(Continued)

*Primary Examiner* — Saul Rodriguez
*Assistant Examiner* — Mark Hageman
(74) *Attorney, Agent, or Firm* — Cantor Colburn LLP

(57) ABSTRACT

A hatch and valve arrangement for a charging installation for a shaft furnace, such as a blast furnace, said arrangement comprising a housing (1), inside which is located at least one hatch (21) and/or a valve (31), caused to pivot by an actuator (25, 35) located outside the housing and connected to the hatch or valve by a linking shaft guided in a bearing that is fixed with respect to the housing. The bearing (24, 34) and the actuator (25, 35) are mounted on a detachable door (26, 36) that seals an opening (13, 15) made in the wall of the housing (1) and whose dimensions are determined such that the hatch or the valve can be withdrawn transversely to the axis of the housing through said opening.

7 Claims, 3 Drawing Sheets

(51) Int. Cl.

| | |
|---|---|
| ***C21B 7/20*** | (2006.01) |
| ***F27B 1/20*** | (2006.01) |
| ***F27D 3/00*** | (2006.01) |

(56) References Cited

U.S. PATENT DOCUMENTS

| | | | | | |
|---|---|---|---|---|---|
| 4,009,081 | A | * | 2/1977 | Ueda et al. | 202/227 |
| 4,514,129 | A | * | 4/1985 | Legille et al. | 414/200 |
| 4,519,519 | A | * | 5/1985 | Meuschke et al. | 220/211 |
| 4,525,120 | A | * | 6/1985 | Legille et al. | 414/160 |
| 4,755,095 | A | * | 7/1988 | Mailliet et al. | 414/200 |
| 5,226,774 | A | * | 7/1993 | Tutt et al. | 414/149 |
| 5,243,901 | A | * | 9/1993 | Green | 100/7 |
| 7,293,668 | B2 | * | 11/2007 | Brossart et al. | 212/177 |

OTHER PUBLICATIONS

International Search Report issued Jul. 23, 2012 re: PCT/EP2012/060581.

* cited by examiner

DOOR AND VALVE ASSEMBLY FOR A CHARGING INSTALLATION OF A SHAFT FURNACE

TECHNICAL FIELD

The present invention relates to a hatch and valve arrangement for a charging installation for a shaft furnace, such as a blast furnace, and more particularly the hatch and valve arrangement used in such a device for firstly controlling the loading of the furnace with solid substances and secondly for preventing gas leaks.

BACKGROUND

Different types of loading installations are already known for shaft furnaces, especially for blast furnaces. Among these, the "Bell Less Top®" installations are now often used because they allow a better control of the loading of the furnace and the dispersion of the loaded materials. Moreover, the sealing system used in these installations allows a better sealing of the pressurised gases contained in the shaft of the blast furnace, principally due to the functional disassociation between the sealing elements on the one hand and the elements designed to control the introduction of the solids into the furnace on the other hand.

Systems of this type are known for example from U.S. Pat. No. 4,514,129 or WO 2010/081810, and generally comprise a pivotable sealing hatch device, called material hatch, to ensure the closure of one or a plurality of material hoppers and to control the material throughput when the hatch is opened. This hatch device can comprise a single flap or two flaps that pivot in opposite directions.

These systems also comprise a sealing valve, located below the hatch, to prevent the gas leaking from the blast furnace to the exterior. In the closed position the underneath of this valve rests against a fixed seat that is an integral part of the hatch and valve arrangement.

The material hatch and the sealing valve are mounted on a housing of the hatch and valve arrangement, on which is connected a hopper for solid material. This housing comprises a central passage with an essentially vertical axis through which the solid material falls into the interior of the blast furnace onto a distribution screen, according to the technique specific to the Bell-Less Top® system.

In the closed position, the material hatch provides the support for the charge of the solid material contained in the hopper, and the valve provides the gas-tightness.

In the open position, during the introduction of the material into the blast furnace, the material hatch, when pivoted into the open position, allows the material to fall. The sealing valve is then completely removed out of the trajectory of the materials, such that the surfaces of the valve ensuring the gas-tightness are not damaged by the solid materials as they fall into the central passage. When loading, the sealing valve is opened first by a pivoting movement, thereby completely freeing the passage, before the feed hatch is opened for the solid material.

Typically, the pivot axis of the sealing valve is essentially perpendicular to the pivot axis of the flap of the hatch, or to the parallel pivot axes of the flaps. The pivoting movement of the hatch and valve is controlled by the respective actuators attached to the housing of the hatch and valve arrangement. These actuators, which can be of the electric or hydraulic type, such as geared motors or jacks, cause the hatch or the flaps of the hatch and the valve respectively to pivot by means of the transmission shafts that pass through the wall of the housing and which are guided in rotation on said housing by the bearings equipped with sealing means.

In the presently known systems, the bearings are directly fixed on the housing of the hatch and valve arrangement. The flaps of the hatch and/or the valves are integral with said shafts, in the interior of the housing, by means of arms. When the hatch or the valve have to be reached for repairs or replacement, or for restoring the seal, one has to intervene inside the housing. The directly involved personnel enters into said housing through an access manway adapted for this purpose in the wall of the housing and carries out his work in a confined space, and moreover in an environment made hazardous by the heat and the presence of blast furnace gases which still remain in spite of the temporary shut-down of the furnace. This shut-down is required for interventions of this kind, during which there is a loss of production.

BRIEF SUMMARY

The invention overcomes the problems mentioned above and in particular proposes a hatch and valve arrangement that enables the time required for these interventions to be as short as possible. It also aims to improve the intervention conditions on the hatches and valves and their pivoting drive elements, to enable interventions of better reliability and to improve the working conditions of the personnel. It also aims to facilitate the complete replacement of a valve or hatch arrangement together with the associated actuators by a similar new or previously renovated arrangement, or by a functionally equivalent construction, but having for example a different design.

Bearing in mind these aims, a hatch and valve arrangement is provided for a charging installation for a shaft furnace, such as a blast furnace, said arrangement comprising a housing, inside which is located at least one such hatch and/or one such valve, which is/are caused to pivot by an actuator located outside the housing and connected to the hatch or valve by a linking shaft guided in a bearing that is fixed with respect to the housing.

According to the invention, the hatch and valve arrangement is characterised in that the bearing and the actuator are mounted on a detachable door that seals an opening made in the wall of the housing and whose dimensions are determined such that the hatch or the valve can be withdrawn transversely to the axis of the housing through said opening.

Incidentally, it should be noted that said "movement transversely to the axis" is understood to mean in particular a change in position of the door, and the removal of the hatch or valve in a direction perpendicular to the axis of the housing, but also in a direction inclined at an angle to said axis. The change in position of the door, and the removal of the hatch or the valve is made along a straight line comprised in a radial plane passing through the axis of the housing.

Thanks to the invention, each module comprising a hatch or a valve with its actuator and its associated means for causing the movement, can be detached in one piece from the housing and removed from it, thereby enabling either a complete replacement by a previously prepared module, or a direct intervention on the module, but then in a more spacious environment and offering better working conditions.

In the systems of the prior art, an intervention to be carried out on a hatch or valve can only be performed inside the housing. If an intervention is required on the means for transmitting movement, for example on the shaft connecting the valve or the hatch to its actuator, one has to first enter inside the housing to initially detach the valve or the hatch and the arm that connects it to the shaft, before being able to extract the shaft into the exterior. In comparison, the invention enables all these operations to be carried out without any intervention inside the housing.

In the case of a complete replacement, the replacement module can be a new or renovated identical module, and this replacement ensures that the intervention time, and therefore the production shut-down, is reduced to a minimum. Alternatively, the extracted module is made available outside the housing on a work bench, where the personnel can take advantage of a very much larger work surface than the restricted area inside the housing. All the replacement or repair operations for the different parts are thus greatly facilitated and can be completed in conditions of highly improved visibility, the interventions being able to be effected for example under natural lighting that facilitates the detection of damage to the hatches or valves and their repair. Moreover, the hydraulic or power supply systems of the actuators do not need to be disconnected, thereby also simplifying the required interventions.

Furthermore, access to the interior of the housing and the visibility are greatly improved because the hatches and valves can be completely removed, thereby no longer forming obstacles to a good view of the interior of the housing, nor to movement of the personnel who may intervene in the interior of said housing.

The invention also obviates the risk of an incorrect manipulation that could cause the valves or hatches to pivot when the personnel are still inside the housing.

According to a particular provision, the door is slidably mounted with respect to the housing, such that once removed from said housing, the complete module can be removed by simply sliding it towards the exterior, in an essentially radial direction with respect to the general axis of the central passage formed in the housing. For that purpose, the arrangement preferably comprises essentially horizontal or slightly inclined guide rails that are preferably fixed on the housing, either in a permanent or detachable manner, and the door possesses sliders or trolleys adapted for moving on the rails, as far as an extreme position where a buffer prevents any movement past the rails. The length of the rails is calculated such that the module can be moved over a distance that is at least sufficient to ensure that the valves or hatches are completely removed outside the housing. It then becomes possible to intervene on all elements of the module while it remains supported on the rails. It is also possible to combine the shifting of the module, when removing it, with a certain pivoting movement, so as to facilitate for example the passage of the hatch or the valve through the opening.

According to an alternative provision that allows, when needed, the constraints of the footprint of the rails to be overcome, the doors comprise linking means for fixing, permanently or temporarily, a disassembly arm that comprises a counterweight, designed to enable the handling of each module by means of lifting equipment. The disassembly arm and its counterweight comprise attachment rings that serve to attach the module to the lifting equipment, thereby ensuring the equilibrium of the module, such that the module can be removed essentially horizontally from the housing, or at least in a position that guarantees the free passage of the valve or hatch through the opening made in the wall of the housing.

BRIEF DESCRIPTION OF DRAWINGS

Other distinguishing features, characteristics and advantages of the invention will emerge from the detailed description of several advantageous illustrative embodiments presented below, on referring to the appended drawings. These show.

DETAILED DESCRIPTION

Figure 1:
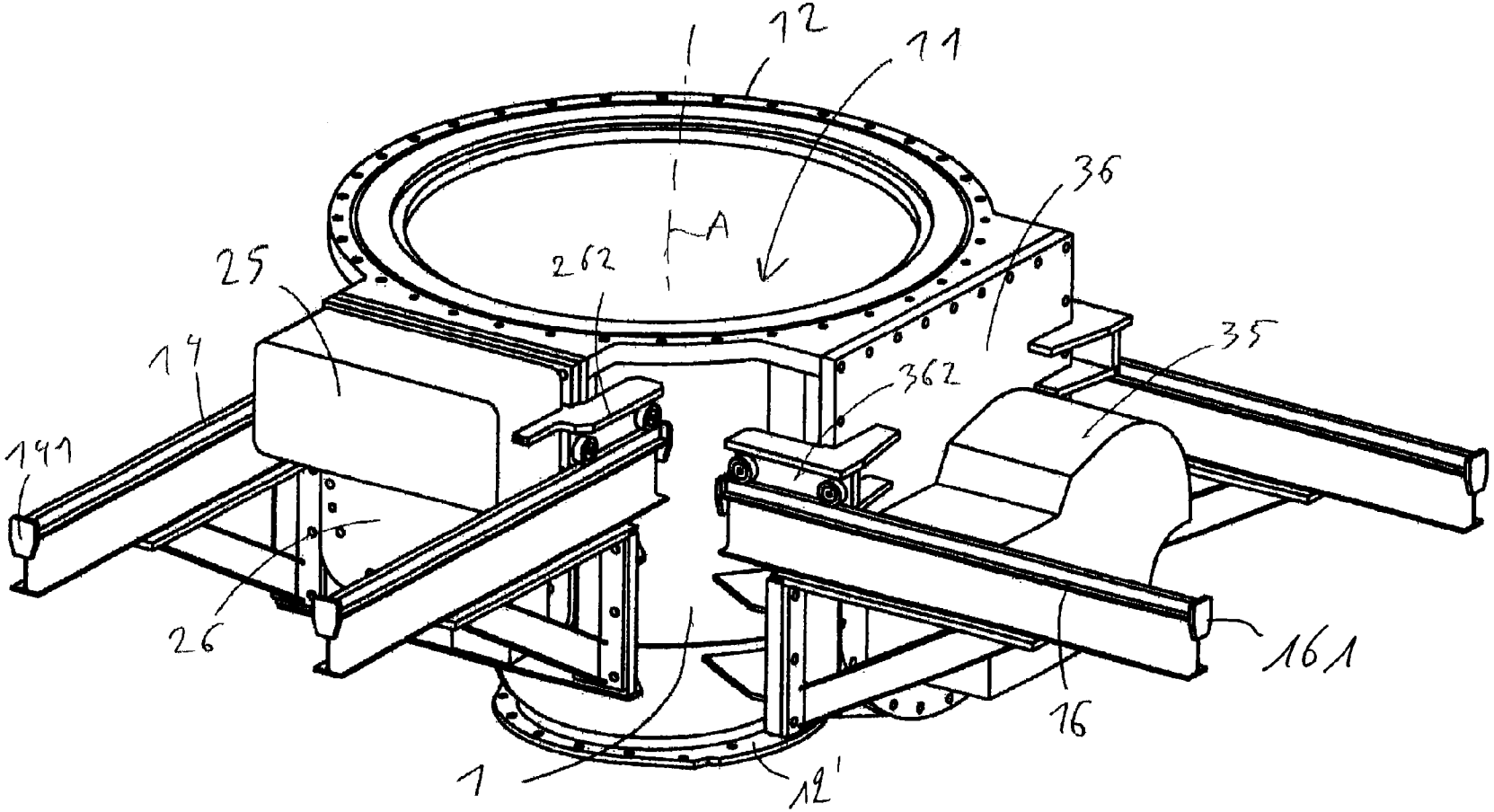
FIG. 1: a perspective view of an arrangement according to the invention in the position of use.
Figure 2:
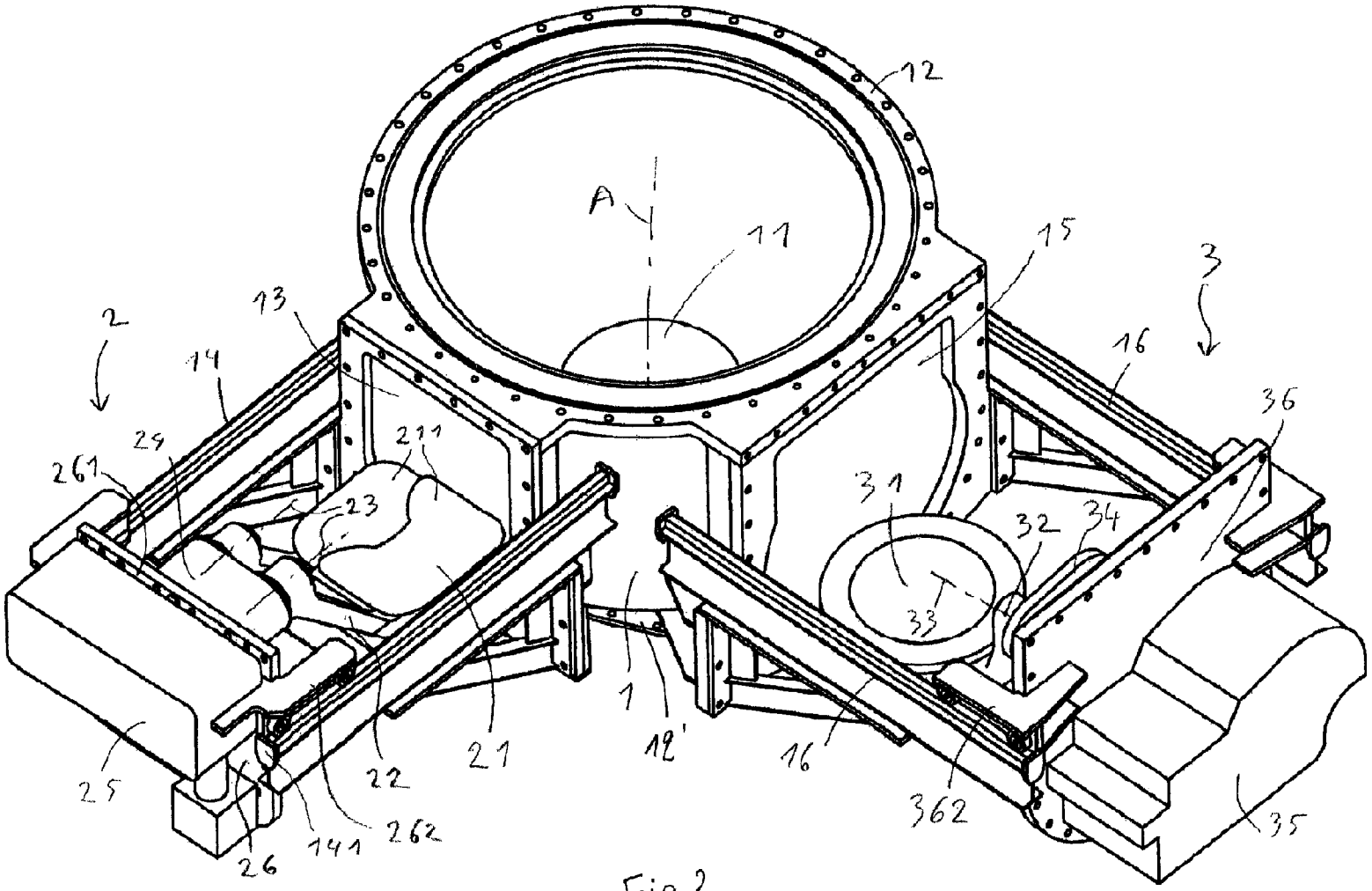
FIG. 2: a view similar to FIG. 1, in which the two modules are outside the housing in the withdrawn position.

The hatch and valve arrangement illustrated in FIGS. 1 and 2 comprises a housing 1 with a central passage 11, having an essentially vertical axis A, for the material to be charged into the blast furnace and provided with a top flange 12 and a bottom flange 12' for fixing the housing onto the charging installation of said blast furnace (not illustrated). It comprises a material hatch module 2 and a sealing valve module 3, essentially offset by 90° about the axis A.

In the illustrated example, the material hatch module 2 comprises a hatch 21 with two flaps 211 that pivot in opposite directions to one another. Each flap is supported on an arm 22, the two arms 22 being mounted on the ends of transmission shafts having parallel axes 23, the shafts being mounted on bearings grouped in an arrangement of bearings 24, and pivotably driven in opposite directions by an actuator 25, known per se. The material hatch module could also comprise only one single pivoting flap.

The bearings 24 and the actuator 25 are mounted on a door 26 adapted to close in a gas-tight manner, for example by a flange system 261, an opening made in the wall of the housing 1, the dimensions of the opening 13 being dictated so as to allow the passage of the hatch arrangement with its control arms assembled on the shafts 23 in their usual position of use. That is to say, as can be seen in FIG. 2, the hatch 21 can pass freely in the opening 13 when the module 2 is shifted radially towards the exterior of the housing, without requiring the flaps or arms to be disassembled beforehand.

In the embodiment of FIGS. 1 and 2, the parallel rails 14 are fixed onto the housing 1 on either side of the opening 13, and the door 26 comprises trolleys 262 designed to roll or slide on the rails 14, such that the module 2 is guided along the rails in a radial direction. The trolleys are manufactured and positioned such that the weight of the module arrangement is supported by the rails and that the module is guided on the rails avoiding any risk of tipping over that could result from the awkward position created by the hatch. In addition, the buffers 141 are provided on the ends of the rails to avoid any risk of the module 2 sliding too far.

The sealing valve module 3 is manufactured in a similar manner to the module 2. It comprises a pivoting valve 31 carried by an arm 32 mounted on the end of a drive shaft having an axis 33 said shaft being mounted in a bearing 34, and made to pivot by an actuator 35, of a type known per se.

The bearing 34 and the actuator 35 are mounted on a door 36 adapted to close in a gas-tight manner, for example by a flange system, an opening 15 made in the wall of the housing 1, the dimensions of the opening 15 being dictated so as to allow the passage of the valve arrangement 31 mounted on its control arm 32 and assembled on the shaft 33 in their usual position of use. That is to say, the valve 31 can pass freely in the opening 15 when still fixed on the arm 32 and therefore connected to the door 36, when the module 3 is shifted radially towards the exterior of the housing.

Just as for the module 2, the parallel rails 16 are fixed onto the housing 1 on either side of the opening 15, and the door 36 comprises trolleys 362 designed to roll or slide on the rails 16, such that the module 3 is guided along the rails in a radial direction. The trolleys are manufactured and positioned such that the weight of the module arrangement is supported by the rails and that the module is guided on the rails avoiding any risk of tipping over that could result from the awkward position created by the valve 31. In addition, the buffers 161 are provided on the ends of the rails to avoid any risk of the module 3 sliding too far.

In the usual working position of the blast furnace, the modules 2 and 3 are assembled by flanging the doors 26 and 36 on the housing 1, at the periphery of the respective openings 13, 15, as illustrated in FIG. 1. When it is required to deal with any of the elements of one of the modules located inside the housing, it suffices to unlock the door and then to slide the complete module on the rails until the hatch or the valve is completely clear of the housing, as illustrated in FIG. 2. It is then possible and easy to repair or replace any element of the module. It is also possible to easily remove the complete module by freeing it from its rails by means of any suitable handling means in order to replace it with another similar module.

Figure 3:
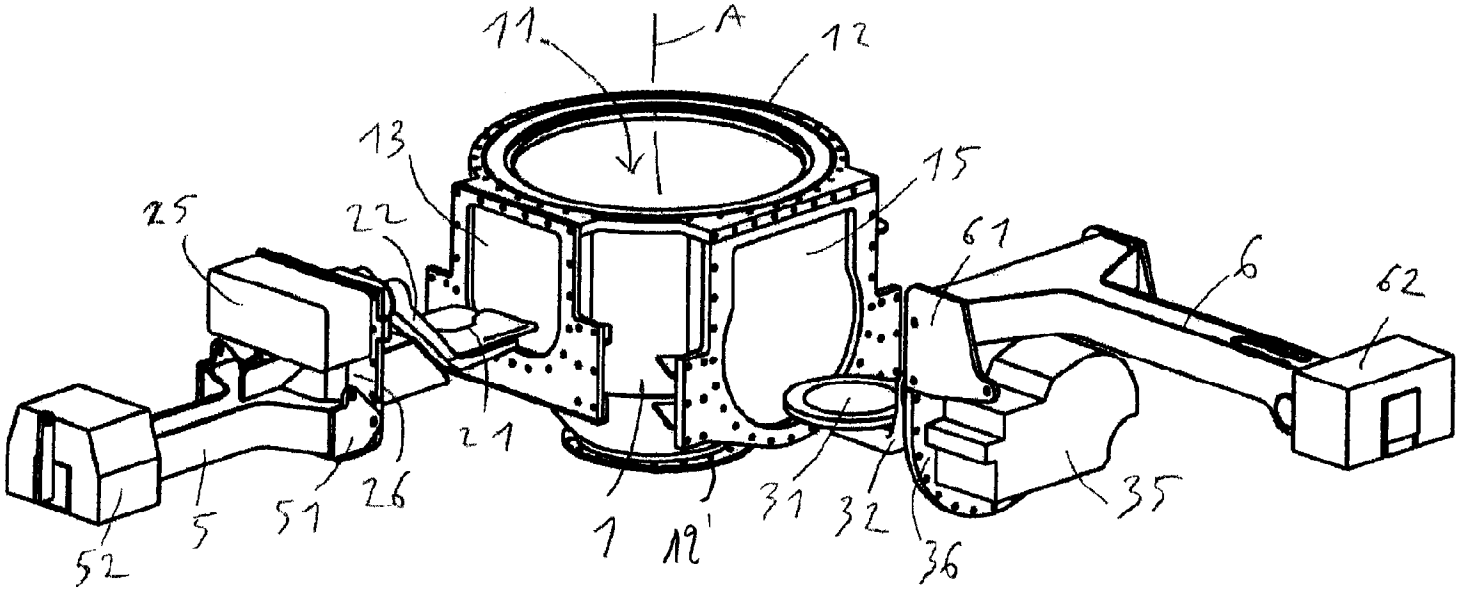
FIG. 3: a perspective view of an arrangement according to a second embodiment of the invention, the two modules being outside the housing in the withdrawn position.

The embodiment illustrated in FIG. 3 is particularly intended for installations where it would not be possible to install the guide rails as in the previously described embodiment.

In this case, the modules 2 and 3 are designed and manufactured in an identical manner to that described previously, but there are no guide rails for supporting and allowing the modules to slide. Consequently, additional lifting means have to be used. In order that the hatch or the valve can pass into the opening of the housing without touching or remaining stuck in the opening, the spatial orientation of the module has to be adequately maintained, i.e. the plane of the door remaining essentially vertical, or the general direction of the pivot axes of the valve or of the hatch remaining essentially horizontal. In order to maintain the general orientation of the module as it is being removed, and therefore to avoid it tipping over as a result of an awkward position created by the valve or hatch, a handling arm 5, 6 is fixed on the door 26, 36 by permanent or detachable mounting brackets 51, 61, and the arm possesses a counterweight 52, 62. The position of the lifting rings, or the like, on the module and the arm, and the weight of the counterweight, are predetermined so as to ensure the equilibrium of the arrangement, and to keep it in the suitable position for removal or the re-installation of the modules, as illustrated in FIG. 3.

The invention is not limited to the embodiments described above solely as illustrative examples. In particular, it can apply to other types of hatches or valves, and to other arrangements of them on the housing of the hatch and valve arrangement.

The invention claimed is:

1. Hatch and valve arrangement for a charging installation for a shaft furnace, comprising:

a housing a housing axis and defining a central passage that extends along the housing axis, a central passage material hatch located in the central passage, the central passage material hatch configured to selectively open/close the central passage, the central passage material hatch caused to pivot by a transmission shaft of a hatch actuator located outside the housing, the transmission shaft directly connected to the central passage material hatch by a single arm and guided in a bearing that is fixed with respect to the housing, the bearing and the actuator mounted on a selectively attachable/detachable material hatch door that when attached seals a hatch opening made in a wall of the housing, the dimensions of the hatch opening determined such that when the door is detached the material hatch can be withdrawn transversely to an axis of the housing through the hatch opening, the material hatch, arm, transmission shaft, hatch actuator, bearing, and door together constitute a material hatch module that is detachable and extractable in one piece from the housing; and a central passage sealing valve located in the central passage and spaced circumferentially on the housing from the central passage material hatch, the central passage sealing valve configured to selectively open/close the central passage, the central passage sealing valve caused to pivot by a transmission shaft of a valve actuator located outside the housing, the transmission shaft directly connected to the central passage sealing valve by a single arm and guided in a bearing that is fixed with respect to the housing, the bearing and the actuator mounted on a selectively attachable/detachable sealing valve door that when attached seals a sealing valve opening made in the wall of the housing, the dimensions of the sealing valve opening determined such that when the door is detached the sealing valve can be withdrawn transversely to an axis of the housing through the sealing valve opening, the sealing valve, arm, transmission shaft, valve actuator, bearing, and sealing valve door together constitute a sealing valve module that is detachable and extractable in one piece from the housing, the material hatch module offset by an angle from the sealing valve module about the housing axis.

2. Hatch and valve arrangement according to claim 1, wherein the material hatch door and the sealing valve door are slidingly mounted with respect to the housing, such that after detachment from the housing, the complete material hatch module and sealing valve module can be removed by sliding towards the exterior.

3. Hatch and valve arrangement according to claim 2, further comprising two pairs of essentially horizontal or slightly inclined guide rails, one pair disposed proximate opposite sides of the material hatch door and the other pair proximate disposed proximate opposite sides of the sealing valve door, wherein the material hatch door and the sealing valve door each comprise sliders or trolleys adapted for moving on the rails.

4. Hatch and valve arrangement according to claim 3, wherein the guide rails are fixed on the housing.

5. Hatch and valve arrangement according to claim 1, wherein the material hatch door and the sealing valve door each comprise linking means wherein a disassembly arm is permanently or temporarily fixed to an outwardly facing surface of each door.

6. Hatch and valve arrangement according to claim 5, wherein each disassembly arm comprises a counterweight and attachment rings for handling each module by means of lifting equipment.

7. Hatch and valve arrangement according to claim 1, wherein the angle is about 90°.

* * * * *